US011827962B2

(12) United States Patent
Yoshidome et al.

(10) Patent No.: US 11,827,962 B2
(45) Date of Patent: Nov. 28, 2023

(54) SOFT MAGNETIC ALLOY, MAGNETIC CORE, MAGNETIC COMPONENT, AND ELECTRONIC DEVICE

(71) Applicant: TDK CORPORATION, Tokyo (JP)

(72) Inventors: Kazuhiro Yoshidome, Tokyo (JP); Satoko Mori, Tokyo (JP); Hiroyuki Matsumoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/210,056

(22) Filed: Mar. 23, 2021

(65) Prior Publication Data

US 2021/0301377 A1 Sep. 30, 2021

(30) Foreign Application Priority Data

Mar. 30, 2020 (JP) ..... 2020-060503

(51) Int. Cl.

| | |
|---|---|
| ***H01F 1/147*** | (2006.01) |
| ***C22C 38/12*** | (2006.01) |
| ***C22C 38/02*** | (2006.01) |
| ***C21D 6/00*** | (2006.01) |
| ***C21D 9/52*** | (2006.01) |

(52) U.S. Cl.

CPC ..... *C22C 38/12* (2013.01); *C21D 6/008* (2013.01); *C21D 9/52* (2013.01); *C22C 38/02* (2013.01); *H01F 1/147* (2013.01); *C22C 2200/04* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 10,535,455 | B2 * | 1/2020 | Harada | C22C 38/005 |
| 10,847,292 | B2 * | 11/2020 | Yoshidome | C22C 38/20 |
| 11,081,266 | B2 * | 8/2021 | Hosono | H01F 27/24 |
| 11,145,448 | B2 * | 10/2021 | Hosono | H01F 1/24 |
| 11,158,443 | B2 * | 10/2021 | Harada | H01F 1/15333 |
| 11,427,896 | B2 * | 8/2022 | Hasegawa | C21D 9/52 |
| 2018/0154434 | A1 | 6/2018 | Henmi et al. | |
| 2021/0313101 | A1 * | 10/2021 | Yamamoto | B22F 9/002 |

FOREIGN PATENT DOCUMENTS

| | | | | |
|---|---|---|---|---|
| JP | 2011-256453 | A | 12/2011 | |
| JP | 2015-167183 | A | 9/2015 | |
| JP | 2016-025352 | A | 2/2016 | |
| JP | 2018-73947 | A | 5/2018 | |
| JP | 6451878 | B1 * | 1/2019 | |
| JP | 6482718 | B1 | 3/2019 | |
| WO | 2019208768 | A1 | 10/2019 | |
| WO | WO-2020026949 | A1 * | 2/2020 | B22F 1/00 |

* cited by examiner

*Primary Examiner* — Humera N. Sheikh
*Assistant Examiner* — Kim S. Horger
(74) *Attorney, Agent, or Firm* — Oliff PLC

(57) ABSTRACT

The present invention provides a soft magnetic alloy having good soft magnetic properties. The soft magnetic alloy includes nanocrystals having an average Heywood diameter value of 5.0 nm or more and 25.0 nm or less, in which an average circularity of the nanocrystals is 0.50 or more and 0.90 or less.

13 Claims, No Drawings

SOFT MAGNETIC ALLOY, MAGNETIC CORE, MAGNETIC COMPONENT, AND ELECTRONIC DEVICE

BACKGROUND OF THE INVENTION

The present invention relates to a soft magnetic alloy, a magnetic core, a magnetic component, and an electronic device.

There is a demand for miniaturization and weight reduction of various electronic components. Along with this, there is a demand for a soft magnetic alloy having improved soft magnetic properties as compared with the related art.

In recent years, it is known that a soft magnetic alloy including nanocrystals has excellent soft magnetic properties. In order to improve soft magnetic properties, various soft magnetic alloys are developed.

Patent Document 1 discloses a soft magnetic alloy including both crystal grains having a crystal grain size of 0.5 nm or more and 60 nm or less and crystal grains having a crystal grain size of 100 nm or more and 500 nm or less.

Patent Document 2 discloses a soft magnetic powder in which both a crystal grain size of nanocrystals and an average thickness of an amorphous phase are within a specific range, an average Fe concentration in the amorphous phase near a surface of the nanocrystals is lower than an average Fe concentration in the nanocrystals, and crystallinity of the soft magnetic powder is high.

Patent Document 3 discloses a soft magnetic alloy powder including a Fe-based alloy particle having a region in which nano-sized FeSi crystals form a columnar structure, and a particle of a soft magnetic material having a metal structure different from that of the Fe-based alloy particle.

[Patent Document 1] Japanese Patent Laid-Open No. 2018-73947

[Patent Document 2] Japanese Patent No. 6482718

[Patent Document 3] International Publication No. 2019/208768

BRIEF SUMMARY OF INVENTION

An object of the present invention is to provide a soft magnetic alloy having good soft magnetic properties.

In order to achieve the above object, a soft magnetic alloy according to the present invention includes nanocrystals having an average Heywood diameter value of 5.0 nm or more and 25.0 nm or less, in which an average circularity of the nanocrystals is 0.50 or more and 0.90 or less.

By having the above characteristics, the soft magnetic alloy according to the present invention is a soft magnetic alloy having good soft magnetic properties.

An average circularity of the nanocrystals may be 0.50 or more and 0.80 or less.

An average circularity of the nanocrystals may be 0.50 or more and 0.70 or less.

An average aspect ratio of the nanocrystals may be 1.2 or more and 1.8 or less.

$R^2/\sigma^2$ may be 30 or less, where R is an average Heywood diameter value of the nanocrystals, and $\sigma$ is a standard deviation of Heywood diameters of the nanocrystals.

The soft magnetic alloy may be a soft magnetic alloy including a main component having a composition formula $(Fe_{(1-(\alpha+\beta))}X1_{\alpha}X2_{\beta})_{(1-(a+b+c+d))}M_aB_bP_cSi_d$ (a ratio of the number of atoms), in which X1 is one or more selected from a group consisting of Co and Ni, X2 is one or more selected from a group consisting of Al, Mn, Ag, Zn, Sn, As, Sb, Cu, Cr, Ga, Bi, N, O, C, S, and a rare earth element, M is one or more selected from a group consisting of Nb, Hf, Zr, Ta, Mo, W, and V, and the following conditions may be satisfied:

$$0 \le a \le 0.150$$

$$0 \le b \le 0.200$$

$$0 \le c \le 0.200$$

$$0 \le d \le 0.200$$

$$0.100 \le a+b+c+d \le 0.300$$

$$\alpha \ge 0,$$

$$\beta \ge 0, \text{ and}$$

$$0 \le \alpha+\beta \le 0.50.$$

The soft magnetic alloy may have a ribbon shape.

The soft magnetic alloy may have a powder shape.

A magnetic core according to the present invention includes the above soft magnetic alloy.

A magnetic component according to the present invention includes the above magnetic core.

An electronic device according to the present invention includes the above magnetic component.

DETAILED DESCRIPTION OF INVENTION

Hereinafter, embodiments of the present invention will be described.

A soft magnetic alloy according to the present embodiment includes nanocrystals having an average Heywood diameter value of 5.0 nm or more and 25.0 nm or less, in which an average circularity of the nanocrystals is 0.50 or more and 0.90 or less.

The soft magnetic alloy according to the present embodiment has good soft magnetic properties by limiting a shape of nanocrystals as described above. That is, a high Bs and a low He are implemented.

In the related art, it is considered that when a circularity of a nanocrystal is high, a degree of filling of the nanocrystal is high and uniformity of an entire soft magnetic alloy is also high, and thus He tends to decrease and soft magnetic properties tend to improve. However, the present inventors find that it is possible to implement a high Bs and a low He when a circularity of a nanocrystal is moderately low.

An average circularity of the nanocrystals may be 0.50 or more and 0.80 or less, and may be 0.50 or more and 0.70 or less.

When an average circularity of the nanocrystals is too small, magnetocrystalline anisotropy occurs, and He increases. In addition, when an average circularity of the nanocrystals is too large, He tends to increase.

An average aspect ratio of the nanocrystals is not particularly limited. The average aspect ratio may be 1.2 or more and 1.8 or less. When the average aspect ratio is within the above range, the soft magnetic properties tend to be better.

An average elliptic circularity of the nanocrystals is not particularly limited. The average elliptic circularity may be 0.80 or more and 0.92 or less, or may be 0.83 or more and 0.92 or less. When the average elliptic circularity is within the above range, the soft magnetic properties tend to be better.

$R^2/\sigma^2$ may be 30 or less, or may be 20 or less, where R is an average Heywood diameter value of the nanocrystals, and a is a standard deviation of Heywood diameters of the nanocrystals. When $R^2/\sigma^2$ is within the above range, the soft magnetic properties tend to be better.

Hereinafter, a method for measuring each of the above parameters will be described.

In the present embodiment, a soft magnetic alloy is observed, and each parameter is calculated based on an obtained image. A device for observing the soft magnetic alloy is not particularly limited. Examples thereof include a transmission electron microscope (TEM). Hereinafter, a method using the TEM will be described.

An evaluation method when the TEM is used is not particularly limited. Examples thereof include a bright field microscopy.

In the present embodiment, in order to accurately evaluate the shape of the nanocrystals, a thickness of a sample used for observation by the TEM (hereinafter, simply referred to as a TEM sample) is made thinner than usual. Specifically, the thickness of the TEM sample is usually about 80 to 100 nm, whereas in the present embodiment the thickness is 20 nm or less. A method for preparing the above TEM sample is not particularly limited, but for example, a TEM sample can be prepared using a focused ion beam-scanning electron microscope (FIB-SEM).

When the TEM sample is thick, a plurality of nanocrystals may overlap in a thickness direction. When the plurality of nanocrystals is overlapped in the thickness direction, the plurality of nanocrystals may appear as a single nanocrystal in a TEM image. That is, the circularity of the nanocrystal may be high in an appearance on the TEM image. Therefore, when the TEM sample is thick, the shape of the nanocrystals may not be evaluated accurately. In the present embodiment, the shape of the nanocrystals can be accurately evaluated by reducing the thickness of the TEM sample. In addition, the thickness of the TEM sample may be evaluated using a convergent-beam electron diffraction (CBED) method or an electron energy-loss spectroscopy (EELS) method, or may be evaluated by directly observing the TEM sample.

A size and a magnification of an image obtained by the TEM are not particularly limited. The size of the image may be any size as long as 10 or more nanocrystals can be observed. In addition, it is sufficient that 100 or more nanocrystals can be observed in a total of a plurality of images. The magnification of the image obtained by the TEM may be any magnification as long as the above parameters can be measured. Specifically, the magnification is about 100,000 to 1,000,000 times.

The Heywood diameter in the present embodiment is a circle equivalent diameter of a projected area. The Heywood diameter of the nanocrystal in the present embodiment is $(4S/\pi)^{1/2}$, where S is an area of the nanocrystal in the image. The average Heywood diameter value can be calculated by averaging Heywood diameters of all the nanocrystals contained in the image obtained by observation.

The circularity in the present embodiment is a parameter also called an area circularity. Specifically, the circularity is $4\pi S/L^2$, where the area of the nanocrystal in the image is S, and a perimeter of the nanocrystal is L. The average circularity can be calculated by averaging circularities of all the nanocrystals contained in the image obtained by observation.

The aspect ratio in the present embodiment can be calculated by dividing a length of a major axis by a length of a minor axis of the nanocrystal in the image. The average aspect ratio can be calculated by averaging aspect ratios of all the nanocrystals contained in the image obtained by observation.

The elliptic circularity in the present embodiment is a so-called circularity corrected by an aspect ratio. Hereinafter, the elliptic circularity of the nanocrystal will be described. In general, in a case where the area of the nanocrystal is constant and the perimeter of the nanocrystal is long, or the perimeter of the nanocrystal is constant and the area of the nanocrystal is small, the circularity of the nanocrystal decreases as compared with a case where the nanocrystal is a perfect circle, that is, the circularity is 1.

Examples of the case where the area of the nanocrystal is constant and the perimeter of the nanocrystal is long include a case where the nanocrystal has irregularities. In addition, examples of the case where the perimeter of the nanocrystal is constant and the area of the nanocrystal is small include a case where the nanocrystal is strained and the aspect ratio of the nanocrystal is increased.

Here, even in the case where the perimeter of the nanocrystal is constant and the area of the nanocrystal is small, that is, even in the case where the aspect ratio of the nanocrystal increases and the nanocrystal becomes an ellipse, the nanocrystal has no irregularities. Therefore, it is possible to evaluate the number of irregularities in the nanocrystal by correcting a circularity that decreases due to an increase in the aspect ratio in addition to the circularity calculated based on the image.

Specifically, the elliptic circularity of the nanocrystal is calculated by $S/(a\times b\times\pi)$, where the length of the major axis is 2a and the length of the minor axis is 2b. When an ellipse has no irregularities, the elliptic circularity is 1, and the more irregularities the ellipse has, the lower the elliptic circularity is. The average elliptic circularity can be calculated by averaging the elliptic circularities of all the nanocrystals contained in the image obtained by observation.

$R^2/\sigma^2$ is a parameter showing a dispersed state of the Heywood diameter of the nanocrystal. The smaller $R^2/\sigma^2$, the greater a deviation in the Heywood diameter of the nanocrystal. $\sigma$ can be calculated based on the Heywood diameters of all the nanocrystals contained in the image obtained by observation.

A type of the nanocrystal in the present embodiment is not particularly limited. The nanocrystal may be an $\alpha$-Fe crystal in which a crystal grain size is in a nano-order.

A composition of the soft magnetic alloy according to the present embodiment is not particularly limited. For example, the soft magnetic alloy may be a soft magnetic alloy including a main component having a composition formula $(Fe_{(1-(\alpha+\beta))}X1_{\alpha}X2_{\beta})_{(1-(a+b+c+d))}M_aB_bP_cSi_d$ (a ratio of the number of atoms), in which X1 is one or more selected from a group consisting of Co and Ni, X2 is one or more selected from a group consisting of Al, Mn, Ag, Zn, Sn, As, Sb, Cu, Cr, Ga, Bi, N, O, C, S, and a rare earth element, M is one or more selected from a group consisting of Nb, Hf, Zr, Ta, Mo, W, and V, and the following conditions may be satisfied:

$$0\le a\le 0.150$$

$$0\le b\le 0.200$$

$$0\le c\le 0.200$$

$$0\le d\le 0.200$$

$$0.100\le a+b+c+d\le 0.300$$

$$\alpha\ge 0,$$

$$\beta\ge 0, \text{ and}$$

$$0\le\alpha+\beta\le 0.50.$$

Hereinafter, each component of the soft magnetic alloy according to the present embodiment will be described in detail.

M is one or more selected from the group consisting of Nb, Hf, Zr, Ta, Mo, W, and V.

M content (a) satisfies $0\le a\le 0.150$. That is, M may not be contained. The M content (a) may satisfy $0.020\le a\le 0.150$, or may satisfy $0.040 \leq a \leq 0.090$. When the M content (a) satisfies $0.040 \leq a \leq 0.090$, the circularity of the nanocrystal tends to be within a predetermined range.

B content (b) satisfies $0 \leq b \leq 0.200$. That is, B may not be contained. The B content (b) may satisfy $0.020 \leq b \leq 0.200$.

P content (c) satisfies $0 \leq c \leq 0.200$. That is, P may not be contained. The P content (c) may satisfy $0.020 \leq c \leq 0.140$.

Si content (d) satisfies $0 \leq d \leq 0.200$. That is, Si may not be contained. The Si content (d) may satisfy $0.010 \leq d \leq 0.150$.

In addition, the soft magnetic alloy according to the present embodiment may satisfy $0.100 \leq a+b+c+d \leq 0.300$.

Further, in the soft magnetic alloy according to the present embodiment, a part of Fe may be substituted with X1 and/or X2.

X1 is one or more selected from the group consisting of Fe and Ni. The X1 content may satisfy $\alpha=0$. That is, X1 may not be contained. The number of atoms of X1 may be 40 at % or less, with respect to a total number of atoms of 100 at % in the composition. That is, the X1 content may satisfy $0 \leq \alpha\{1-(a+b+c+d)\} \leq 0.400$. In addition, the X1 content may satisfy $0 \leq \alpha\{1-(a+b+c+d)\} \leq 0.100$.

X2 is one or more selected from the group consisting of Al, Mn, Ag, Zn, Sn, As, Sb, Cu, Cr, Ga, Bi, N, O, C, S, and the rare earth element. X2 may be one or more selected from a group consisting of Al, Zn, Sn, Cu, Cr, Ga, Bi, La, Y, N, O, C, and S. The X2 content may satisfy $\beta=0$. That is, X2 may not be contained. The number of atoms of X2 may be 5.0 at % or less, or 3.0 at % or less, with respect to the total number of atoms of 100 at % in the composition. That is, the X2 content may satisfy $0 \leq \beta\{1-(a+b+c+d)\} \leq 0.050$, or may satisfy $0 \leq \beta\{1-(a+b+c+d)\} \leq 0.030$.

A range of a substitution amount for substituting Fe with X1 and/or X2 may be half or less of Fe based on the number of atoms. That is, $0 \leq \alpha+\beta \leq 0.50$ may be satisfied.

The soft magnetic alloy according to the present embodiment may contain elements other than elements contained in the above main component as inevitable impurities within a range that does not significantly affect the soft magnetic properties. For example, the inevitable impurities may be contained in an amount of 0.1% by mass or less with respect to 100% by mass of the soft magnetic alloy.

By having the above composition, the soft magnetic alloy according to the present embodiment tends to include nanocrystals which are α-Fe crystals after a heat treatment described later. Further, it becomes difficult to include crystals larger than nanocrystals (specifically, crystals having a crystal grain size of 0.1 μm or more). Then, it becomes easy to improve the soft magnetic properties. A presence or absence of the crystals larger than nanocrystals can be confirmed by X-ray diffraction (XRD).

A shape of the soft magnetic alloy is not particularly limited. Examples thereof include a ribbon shape and a powder shape.

Hereinafter, a method for manufacturing the soft magnetic alloy in the present embodiment will be described.

The method for manufacturing the soft magnetic alloy according to the present embodiment is not particularly limited, but examples thereof include a method of manufacturing a ribbon of a soft magnetic alloy by a single-roll method.

In the single-roll method, first, pure metals of metal elements contained in a soft magnetic alloy to be finally obtained are prepared, and weighed so as to have the same composition as the soft magnetic alloy to be finally obtained. Then, the pure metals of the metal elements are melted and mixed to prepare a base alloy. A method for melting the pure metals is not particularly limited, but for example, there is a method for melting the pure metals by high frequency heating after vacuum-evacuating the pure metals in a chamber. The base alloy and the soft magnetic alloy to be finally obtained usually have the same composition.

Next, the prepared base alloy is heated and melted to obtain a molten metal. A temperature of the molten metal is not particularly limited, but can be, for example, 1200 to 1400° C.

In the single-roll method, a thickness of the obtained ribbon can be adjusted mainly by adjusting a rotation speed of a roll, but for example, the thickness of the obtained ribbon can also be adjusted by adjusting a distance between a nozzle and the roll, the temperature of the molten metal, and the like. The thickness of the ribbon is not particularly limited, but can be, for example, 15 to 30 μm.

A temperature of a roll 23 and a vapor pressure inside the chamber are not particularly limited. For example, the temperature of the roll may be from room temperature to 50° C. An atmosphere inside the chamber may be in the air, or may be an inert gas atmosphere.

Next, stress is applied to the ribbon of the soft magnetic alloy thus obtained. Specifically, the stress is applied to a surface perpendicular to a thickness direction of the ribbon.

The average circularity of the nanocrystals can be reduced by applying and releasing the stress and then performing the heat treatment described later. In addition, the larger a stress loading amount, the lower the average circularity of the nanocrystals. Further, the larger a stress loading amount, the higher the average aspect ratio of the nanocrystals and the lower the average elliptic circularity. A detailed reason for a decrease in the average circularity and the average elliptic circularity of the nanocrystals is unknown. However, it is considered that a strain is formed inside the soft magnetic alloy by applying the stress to the soft magnetic alloy, and thus this strain affects formation of the nanocrystals, and the average circularity, and the average elliptic circularity of the nanocrystals are lowered.

A device for applying the stress is not particularly limited. For example, a hand press can be used. The stress loading amount is not particularly limited as long as the average circularity of the nanocrystals is finally within a specific range. The larger the stress loading amount, the lower the average circularity of the nanocrystals tends to be. In addition, a time for applying the stress, that is, a time between application and release of the stress is also not particularly limited. For example, the time may be 0.5 minutes or more and 1 minute or less.

Next, the heat treatment is performed on the soft magnetic alloy. Heat treatment conditions are not particularly limited. Preferable heat treatment conditions differ depending on the composition of the soft magnetic alloy. A heat treatment temperature may be 450° C. or higher and 700° C. or lower. In addition, a temperature increase rate at which the temperature is increased from room temperature to the heat treatment temperature may be 5° C./min or more and 320° C./min or less.

The higher the heat treatment temperature, the higher the average Heywood diameter value of the nanocrystals tends to be. In addition, the average circularity of the nanocrystals also tends to increase.

The longer a heat treatment time, the higher the average Heywood diameter value of the nanocrystals tends to be. In addition, the average circularity of the nanocrystals also tends to increase. Further, $R^2/\sigma^2$ also tends to decrease.

The faster the temperature increase rate, the lower the average Heywood diameter value of the nanocrystals tends to be. In addition, the average circularity tends to be small when the temperature increase rate is about 20 to 80° C./min. The average circularity tends to increase regardless of whether the temperature increase rate is high or low. Further, the faster the temperature increase rate, the smaller the average aspect ratio tends to be.

A soft magnetic alloy ribbon according to the present embodiment can be obtained by the above method.

Next, a method for obtaining a soft magnetic alloy powder according to the present embodiment will be described. Usually, one powder particle contains a large number of nanocrystals. Therefore, a particle size of the powder particle and a crystal grain size of the nanocrystals (Heywood diameter of the nanocrystals) are different.

Examples of the method for obtaining the soft magnetic alloy powder according to the present embodiment include a method for obtaining the magnetic alloy powder by pulverizing the above soft magnetic alloy ribbon. A pulverizing method is not particularly limited, and pulverization can be performed by any method. The shape of the nanocrystals does not substantially change before and after the pulverization.

In addition, examples of the method for obtaining the soft magnetic powder according to the present embodiment include a method for obtaining the soft magnetic powder according to the present embodiment by a water atomizing method or a gas atomizing method.

For example, in the gas atomizing method, a molten alloy is obtained in the same manner as in the single-roll method described above. Then, the molten alloy is injected in the chamber to prepare a powder. At this time, a gas injection temperature may be 1200 to 1600° C. The atmosphere in the chamber may be in the air, or may be the inert gas atmosphere.

Next, stress is applied to the powder of the soft magnetic alloy thus obtained. Specifically, the powder is filled in a mold, and the stress is applied.

The average circularity of the nanocrystals can be reduced by applying and releasing the stress, and then performing a heat treatment described later. In addition, the larger a stress loading amount, the lower the average circularity of the nanocrystals. Further, the average aspect ratio of the nanocrystals increases, and the average elliptic circularity decreases.

A device for applying the stress is not particularly limited. For example, a hand press can be used. The stress loading amount is not particularly limited as long as the average circularity of the nanocrystals is finally within a specific range. The larger the stress loading amount, the lower the average circularity of the nanocrystals tends to be. In addition, a time for applying the stress, that is, a time between application and release of the stress is also not particularly limited. For example, the time may be 0.5 minutes or more and 1 minute or less.

Next, the heat treatment is performed on the powder after the stress is applied and released. Heat treatment conditions are not particularly limited. Preferable heat treatment conditions differ depending on the composition of the soft magnetic alloy. A heat treatment temperature may be 450° C. or higher and 700° C. or lower. In addition, a temperature increase rate at which the temperature is increased from room temperature to the heat treatment temperature may be 5° C./min or more and 320° C./min or less.

A magnetic core according to the present embodiment includes the above soft magnetic alloy. A method for preparing the magnetic core from the soft magnetic alloy ribbon, the soft magnetic alloy powder, or a soft magnetic alloy having other shapes is not particularly limited. It is sufficient to prepare the magnetic core by a usually used method.

A magnetic component according to the present embodiment includes the above magnetic core. A type of the magnetic component is not particularly limited, and examples thereof include a magnetic component required to have excellent soft magnetic properties, such as a coil component and a dust core. In addition, examples of the coil component include a reactor, a choke coil, and a transformer. Further, an electronic device according to the present embodiment includes the above magnetic component. A type of the electronic device is not particularly limited, and examples thereof include a DC-DC converter. Furthermore, an application of the electronic device is not particularly limited, and examples thereof include a hybrid electric vehicle (HEV), a plug-in hybrid vehicle (PHEV), and an electric vehicle (EV).

EXAMPLES

Hereinafter, the present invention will be specifically described based on Examples.

Experimental Example 1

Raw material metals were weighed to obtain an alloy composition of $Fe_{0.840}Nb_{0.070}B_{0.080}Si_{0.010}$, and melted by high frequency heating to prepare a base alloy.

Thereafter, the prepared base alloy was heated and melted to form a metal in a molten state at 1500° C., and then the metal was injected onto a roll by a single-roll method in the air to prepare a ribbon.

An X-ray diffraction measurement was performed on each of the obtained ribbons, and it was confirmed that there were no crystals larger than nanocrystals.

Thereafter, a stress was applied to a ribbon in each of Examples and Comparative Examples. Specifically, first, a ribbon prepared by the single-roll method was processed into a disk shape of Φ8 mm. Then, five processed ribbons were stacked in a thickness direction. The stacked ribbons were placed in a Φ8 mm mold, a stress was applied to a surface perpendicular to the thickness direction at a stress loading amount shown in Table 1 for 0.5 minutes, and then the stress was released. A hand press was used to apply the stress. No stress was applied to sample No. 1.

Thereafter, a heat treatment was performed at a temperature increase rate of 40° C./min from room temperature to a heat treatment temperature, a heat treatment time of 1.0 hour, and the heat treatment temperature of 600° C. In addition, the heat treatment time refer to a time during which the heat treatment temperature was maintained.

It was confirmed by ICP analysis that a composition of the ribbon obtained after the heat treatment and a composition of the base alloy did not change.

It was confirmed by an X-ray diffractometer (XRD) that each ribbon after the heat treatment contained nanocrystals of α-Fe. Further, observation was performed using a transmission electron microscope (TEM). In the observation using the TEM, a TEM sample was prepared using FIB such that a thickness was 20 nm. The thickness of the TEM sample was confirmed by an electron energy loss spectroscopy (EELS). A Heywood diameter, a circularity, an elliptic circularity, and an aspect ratio were measured for at least 100 nanocrystals in the observation using the TEM. Then, an average Heywood diameter value R, an average circularity, an average elliptic circularity, an average aspect ratio, and a standard deviation of Heywood diameter a of the nanocrystals contained in each ribbon were calculated. Results are shown in Table 1.

Furthermore, a saturation magnetic flux density Bs and a coercivity He of each of the Examples and Comparative Examples were measured. Bs was measured at a magnetic field of 1000 kA/m using a vibrating sample magnetometer (VSM). He was measured at a magnetic field of 5 kA/m using a DC BH tracer. Results are shown in Table 1. Regarding Bs, a value of 1.30 T or more was considered as good. Regarding He, a value sufficiently lower than that in Comparative Example of sample No. 1 to which no stress was applied was considered as good. In Table 1, regarding He, a value of 0.100 Oe or less was considered as good.

TABLE 1

| Sample No. | Example/Comparative Example | Stress loading amount (MPa) | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|
| 1 | Comparative Example | 0 | 14.3 | 0.93 | 1.0 | 2.1 | 46 | 0.97 | 1.42 | 0.125 |
| 2 | Example | 100 | 14.2 | 0.84 | 1.1 | 2.8 | 26 | 0.93 | 1.43 | 0.088 |
| 3 | Example | 200 | 14.4 | 0.72 | 1.2 | 3.5 | 17 | 0.83 | 1.42 | 0.083 |
| 4 | Example | 400 | 14.3 | 0.64 | 1.4 | 5.1 | 8 | 0.84 | 1.43 | 0.079 |
| 5 | Example | 800 | 14.3 | 0.51 | 1.8 | 6.2 | 5 | 0.87 | 1.43 | 0.078 |
| 6 | Comparative Example | 1000 | 28.3 | 0.64 | 1.4 | 20.4 | 2 | 0.92 | 1.43 | 0.150 |

According to Table 1, as compared with sample No. 1 in which an average circularity of nanocrystals was higher than 0.90 and without applying a stress before a heat treatment, samples No. 2 to No. 5, in which an average Heywood diameter value R of nanocrystals was 5.0 nm or more and 25.0 nm or less and an average circularity of the nanocrystals was 0.50 or more and 0.90 or less by applying a stress before a heat treatment, had the same good Bs and a significantly reduced Hc. In sample No. 6 in which a stress loading amount was too large, nanocrystals grew too much. An average Heywood diameter value R increased, and He increased.

Experimental Example 2

In Experimental Example 2, a ribbon was prepared in the same manner as in Experimental Example 1 except that heat treatment conditions were changed between a case where a stress loading amount was 0 (no stress was applied) (sample No. 1) and a case where a stress loading amount was 400 MPa (sample No. 4), and evaluated. Results are shown in Tables 2A to 2C. An evaluation criteria for Bs and He were the same as in Experimental Example 1.

TABLE 2A

| Sample No. | Example/ Comparative Example | Stress loading amount (MPa) | Heat treatment temperature (° C.) | Temperature increase rate (° C./min) | Heat treatment time (h) | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|---|---|
| 7 | Comparative Example | 0 | 300 | 40 | 1.0 | 2.4 | 0.92 | 1.1 | 1.1 | 5 | 0.99 | 1.10 | 0.137 |
| 8 | Comparative Example | 0 | 450 | 40 | 1.0 | 5.2 | 0.92 | 1.1 | 1.8 | 8 | 0.95 | 1.30 | 0.134 |
| 9 | Comparative Example | 0 | 550 | 40 | 1.0 | 13.6 | 0.91 | 1.0 | 2.3 | 35 | 0.95 | 1.35 | 0.122 |
| 10 | Comparative Example | 0 | 575 | 40 | 1.0 | 14.1 | 0.92 | 1.0 | 2.1 | 45 | 0.96 | 1.39 | 0.111 |
| 1 | Comparative Example | 0 | 600 | 40 | 1.0 | 14.3 | 0.93 | 1.0 | 2.1 | 46 | 0.97 | 1.43 | 0.125 |
| 11 | Comparative Example | 0 | 625 | 40 | 1.0 | 19.4 | 0.93 | 1.1 | 3.1 | 39 | 0.96 | 1.44 | 0.134 |
| 12 | Comparative Example | 0 | 650 | 40 | 1.0 | 22.4 | 0.92 | 1.1 | 7.3 | 9 | 0.97 | 1.45 | 0.165 |
| 13 | Comparative Example | 0 | 700 | 40 | 1.0 | 24.4 | 0.92 | 1.2 | 10.5 | 5 | 0.96 | 1.46 | 1.567 |
| 14 | Comparative Example | 400 | 300 | 40 | 1.0 | 2.5 | 0.63 | 1.3 | 2.5 | 1 | 0.99 | 1.10 | 0.123 |
| 15 | Example | 400 | 450 | 40 | 1.0 | 5.1 | 0.64 | 1.3 | 3.2 | 3 | 0.91 | 1.30 | 0.099 |
| 16 | Example | 400 | 550 | 40 | 1.0 | 13.3 | 0.65 | 1.5 | 3.7 | 13 | 0.82 | 1.35 | 0.082 |
| 17 | Example | 400 | 575 | 40 | 1.0 | 14.2 | 0.64 | 1.5 | 4.3 | 11 | 0.83 | 1.39 | 0.072 |
| 4 | Example | 400 | 600 | 40 | 1.0 | 15.8 | 0.64 | 1.4 | 5.1 | 10 | 0.84 | 1.43 | 0.079 |
| 18 | Example | 400 | 625 | 40 | 1.0 | 23.9 | 0.66 | 1.4 | 4.9 | 24 | 0.92 | 1.44 | 0.099 |
| 19 | Comparative Example | 400 | 650 | 40 | 1.0 | 25.8 | 0.77 | 1.2 | 7.4 | 12 | 0.96 | 1.45 | 0.134 |
| 20 | Comparative Example | 400 | 700 | 40 | 1.0 | 26.8 | 0.81 | 1.2 | 10.5 | 7 | 0.95 | 1.46 | 1.893 |

TABLE 2B

| Sample No. | Example/ Comparative Example | Stress loading amount (MPa) | Heat treatment temperature (° C.) | Temperature increase rate (° C./min) | Heat treatment time (h) | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|---|---|
| 21 | Comparative Example | 0 | 600 | 5 | 0.5 | 15.4 | 0.95 | 1.1 | 2.8 | 30 | 0.97 | 1.43 | 0.134 |
| 22 | Comparative Example | 0 | 600 | 10 | 0.5 | 14.7 | 0.94 | 1.1 | 2.6 | 32 | 0.97 | 1.43 | 0.111 |
| 23 | Comparative Example | 0 | 600 | 20 | 0.5 | 14.6 | 0.93 | 1.2 | 2.8 | 27 | 0.96 | 1.42 | 0.112 |
| 24 | Comparative Example | 0 | 600 | 40 | 0.5 | 13.8 | 0.93 | 1.2 | 3.1 | 20 | 0.96 | 1.42 | 0.119 |
| 25 | Comparative Example | 0 | 600 | 80 | 0.5 | 12.7 | 0.93 | 1.2 | 3.2 | 16 | 0.95 | 1.41 | 0.108 |
| 26 | Comparative Example | 0 | 600 | 160 | 0.5 | 11.4 | 0.93 | 1.2 | 1.9 | 36 | 0.95 | 1.40 | 0.124 |
| 27 | Comparative Example | 0 | 600 | 320 | 0.5 | 10.1 | 0.92 | 1.1 | 1.8 | 31 | 0.94 | 1.40 | 0.132 |
| 28 | Example | 400 | 600 | 5 | 0.5 | 15.3 | 0.83 | 2.4 | 2.2 | 48 | 0.92 | 1.43 | 0.099 |
| 29 | Example | 400 | 600 | 10 | 0.5 | 14.8 | 0.76 | 1.8 | 2.6 | 32 | 0.85 | 1.43 | 0.079 |
| 30 | Example | 400 | 600 | 20 | 0.5 | 14.3 | 0.66 | 1.6 | 2.9 | 24 | 0.82 | 1.42 | 0.075 |
| 31 | Example | 400 | 600 | 40 | 0.5 | 13.5 | 0.66 | 1.3 | 3.2 | 18 | 0.76 | 1.42 | 0.073 |
| 32 | Example | 400 | 600 | 80 | 0.5 | 12.8 | 0.70 | 1.2 | 2.8 | 21 | 0.81 | 1.42 | 0.075 |
| 33 | Example | 400 | 600 | 160 | 0.5 | 11.6 | 0.75 | 1.1 | 2.1 | 31 | 0.86 | 1.41 | 0.087 |
| 34 | Example | 400 | 600 | 320 | 0.5 | 11.5 | 0.82 | 1.1 | 1.9 | 37 | 0.93 | 1.41 | 0.098 |

TABLE 2C

| Sample No. | Example/ Comparative Example | Stress loading amount (MPa) | Heat treatment temperature (° C.) | Temperature increase rate (° C./min) | Heat treatment time (h) | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|---|---|
| 35 | Comparative Example | 0 | 600 | 40 | 0.01 | 13.7 | 0.92 | 1.1 | 2.2 | 39 | 0.96 | 1.41 | 0.122 |
| 36 | Comparative Example | 0 | 600 | 40 | 0.1 | 14.6 | 0.91 | 1.0 | 2.3 | 40 | 0.96 | 1.42 | 0.123 |
| 24 | Comparative Example | 0 | 600 | 40 | 0.5 | 14.3 | 0.93 | 1.1 | 2.2 | 42 | 0.95 | 1.43 | 0.125 |
| 1 | Comparative Example | 0 | 600 | 40 | 1.0 | 14.3 | 0.93 | 1.0 | 2.1 | 46 | 0.97 | 1.43 | 0.125 |
| 37 | Comparative Example | 0 | 600 | 40 | 3.0 | 14.2 | 0.92 | 1.1 | 2.2 | 42 | 0.96 | 1.43 | 0.128 |
| 38 | Comparative Example | 0 | 600 | 40 | 10.0 | 14.4 | 0.95 | 1.0 | 2.1 | 47 | 0.95 | 1.43 | 0.121 |
| 41 | Example | 400 | 600 | 40 | 0.01 | 13.2 | 0.62 | 1.3 | 2.5 | 28 | 0.77 | 1.42 | 0.082 |
| 42 | Example | 400 | 600 | 40 | 0.1 | 13.2 | 0.63 | 1.3 | 2.8 | 22 | 0.78 | 1.42 | 0.073 |
| 31 | Example | 400 | 600 | 40 | 0.5 | 13.5 | 0.66 | 1.3 | 3.2 | 18 | 0.76 | 1.42 | 0.073 |
| 4 | Example | 400 | 600 | 40 | 1.0 | 15.8 | 0.64 | 1.4 | 5.1 | 10 | 0.84 | 1.43 | 0.079 |
| 43 | Example | 400 | 600 | 40 | 3.0 | 14.4 | 0.67 | 1.3 | 5.8 | 6 | 0.85 | 1.42 | 0.071 |
| 44 | Example | 400 | 600 | 40 | 10.0 | 14.6 | 0.68 | 1.3 | 6.4 | 5 | 0.84 | 1.42 | 0.074 |

According to Tables 2A to 2C, as compared with a Comparative Example carried out under the same conditions except that no stress was applied, an Example, in which an average Heywood diameter value R of nanocrystals was 5.0 nm or more and 25.0 nm or less and an average circularity of the nanocrystals was 0.50 or more and 0.90 or less even when heat treatment conditions were changed, had the same good Bs and a significantly reduced Hc.

Comparing sample No. 7 (without a stress applied) and sample No. 14 (with a stress applied) in Table 2A, an average circularity of nanocrystals was lower in sample No. 14, but He did not decrease sufficiently in sample No. 14. This is because an average Heywood diameter value R of nanocrystals in sample No. 14 was too small. In addition, the same results were also obtained by comparing sample No. 12 and sample No. 13 (without a stress applied) with sample No. 19 and sample No. 20 (with a stress applied) in Table 2A. This is because an average Heywood diameter value R was too large in sample No. 19 and sample No. 20.

Experimental Example 3

In Experimental Example 3, a base alloy was prepared in the same manner as in Experimental Example 1. Then, the prepared base alloy was heated and melted to obtain a metal in a molten state at 1500° C., and then the metal was injected by a gas atomizing method to prepare a powder. A gas injection temperature was 25° C.

An X-ray diffraction measurement was performed on the obtained powder, and it was confirmed that there were no crystals larger than nanocrystals.

Thereafter, 2 g of the obtained powder was weighed. Then, the weighed powder was poured into a Φ8 mm mold. Next, a stress was applied to the powder, which was poured into the mold, by a hand press machine for 0.5 minutes at a stress loading amount shown in Table 3. Next, the pressurized powder was taken out from the mold. No stress was applied to a powder of sample No. 45.

Thereafter, a heat treatment was performed on each powder at a temperature increase rate of 40° C./min from room temperature to a heat treatment temperature, a heat treatment time of 1.0 hour, and the heat treatment temperature of 600° C. The heat treatment time refers to a time during which the heat treatment temperature was maintained.

It was confirmed by ICP analysis that a composition of the powder obtained after the heat treatment and a composition of the base alloy did not change.

It was confirmed by an X-ray diffractometer (XRD) that each powder after the heat treatment contained nanocrystals of α-Fe. Further, observation was performed using a transmission electron microscope (TEM). A crystal structure of each powder after the heat treatment was confirmed by observation using a transmission electron microscope (TEM). The observation using the TEM was performed by an electron energy loss spectroscopy (EELS) on a TEM sample with a thickness of 20 nm. A Heywood diameter, a circularity, an elliptic circularity, and an aspect ratio were measured for at least 100 nanocrystals by the observation using the TEM. Then, an average Heywood diameter value R, an average circularity, an average elliptic circularity, an average aspect ratio, and a standard deviation of Heywood diameter a of the nanocrystals contained in each powder were calculated. Results are shown in Table 3.

Furthermore, a saturation magnetic flux density Bs and a coercivity He were measured for each powder after the heat treatment. Bs was measured at a magnetic field of 1000 kA/m using a vibrating sample magnetometer (VSM). He was measured at a magnetic field of 5 kA/m using a DC BH tracer. Results are shown in Table 3. Bs of 1.30 T or more was considered as good. He of 1.00 Oe or less was considered as good.

TABLE 3

| Sample No. | Example/Comparative Example | Stress loading amount (MPa) | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|
| 45 | Comparative Example | 0 | 14.3 | 0.95 | 1.0 | 2.1 | 46 | 0.97 | 1.42 | 1.40 |
| 46 | Example | 100 | 14.3 | 0.83 | 1.1 | 2.9 | 24 | 0.91 | 1.43 | 0.83 |
| 47 | Example | 200 | 14.2 | 0.71 | 1.2 | 3.3 | 19 | 0.85 | 1.42 | 0.78 |
| 48 | Example | 400 | 14.6 | 0.66 | 1.3 | 4.8 | 9 | 0.83 | 1.43 | 0.67 |
| 49 | Example | 800 | 14.8 | 0.52 | 1.8 | 5.3 | 8 | 0.85 | 1.43 | 0.71 |
| 50 | Comparative Example | 1000 | 29.6 | 0.77 | 1.3 | 25.2 | 1 | 0.96 | 1.43 | 2.52 |

According to Table 3, as compared with sample No. 45 in which an average circularity of nanocrystals was higher than 0.90 and without applying a stress before a heat treatment, sample No. 46 to sample No. 49, in which an average Heywood diameter value R of nanocrystals was 5.0 nm or more and 25.0 nm or less and an average circularity of the nanocrystals was 0.50 or more and 0.90 or less by applying a stress before a heat treatment, had the same good Bs and a significantly reduced Hc. In sample No. 50 in which a stress loading amount was too large, nanocrystals grew too much. An average Heywood diameter value R increased, and He increased. In other words, Experimental Example 3 which was an experimental example of powder obtained the same results as Experimental Example 1 which was an experimental example of a ribbon.

Experimental Example 4

Preparation conditions of a powder were the same as in Experimental Example 3 except for a composition. Table 4 shows Comparative Examples in which a stress was not applied as in sample No. 45 and a type of an M element was changed from Nb, and Examples in which a stress loading amount was 400 MPa, which was the same as that of sample No. 48, and a type of an M element was changed from Nb. Tables 5 to 8 show Examples in which a stress loading amount was 400 MPa, which was the same as that of sample No. 48, and values a to d were changed appropriately. Table 9 shows Examples in which a stress loading amount was 400 MPa, which was the same as that of sample No. 48, and a part of Fe in sample No. 48 was substituted with X1 and/or X2.

In sample No. 51 to sample No. 119 shown in Tables 4 to 9, a heat treatment temperature of each sample was appropriately changed from Experimental Example 3. Specifically, a heat treatment was performed at a heat treatment time of 1.0 h, a temperature increase rate of 40° C./min, and a heat treatment temperature of 450 to 650° C. in increments of 50° C. A temperature at which the coercivity after the heat treatment became the lowest was set as an optimum heat treatment temperature in a composition of the sample. An average Heywood diameter value R, an average circularity, an average elliptic circularity, an average aspect ratio, and a standard deviation of Heywood diameter a of the nanocrystals contained in a powder prepared by a heat treatment at the optimum heat treatment temperature were calculated. Results are shown in Tables 5 to 9.

TABLE 4

| Sample No. | Example/Comparative Example | Stress loading amount | M elemental species | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|
| 45 | Comparative Example | 0 | Nb | 14.3 | 0.95 | 1.0 | 2.1 | 46 | 0.97 | 1.42 | 1.40 |
| 51 | Comparative Example | 0 | Ta | 13.5 | 0.93 | 1.1 | 2.2 | 38 | 0.98 | 1.44 | 1.32 |
| 52 | Comparative Example | 0 | W | 14.5 | 0.92 | 1.1 | 2.1 | 48 | 0.97 | 1.43 | 1.11 |
| 53 | Comparative Example | 0 | Zr | 14.3 | 0.95 | 1.0 | 2.3 | 39 | 0.95 | 1.45 | 1.24 |
| 54 | Comparative Example | 0 | Hf | 14.4 | 0.93 | 1.1 | 2.3 | 39 | 0.99 | 1.43 | 1.46 |
| 55 | Comparative Example | 0 | Mo | 14.7 | 0.94 | 1.1 | 2.2 | 45 | 0.95 | 1.44 | 1.56 |
| 56 | Comparative Example | 0 | V | 14.4 | 0.94 | 1.1 | 2.4 | 36 | 0.96 | 1.43 | 1.48 |
| 57 | Comparative Example | 0 | Nb:Hf = 1:1 | 14.7 | 0.95 | 1.1 | 2.1 | 49 | 0.95 | 1.44 | 1.36 |
| 58 | Comparative Example | 0 | Nb:Zr = 1:1 | 14.6 | 0.94 | 1.1 | 1.8 | 66 | 0.96 | 1.42 | 1.35 |
| 48 | Example | 400 | Nb | 14.6 | 0.66 | 1.3 | 4.8 | 9 | 0.83 | 1.43 | 0.67 |
| 59 | Example | 400 | Ta | 13.5 | 0.66 | 1.3 | 3.2 | 18 | 0.85 | 1.44 | 0.77 |
| 60 | Example | 400 | W | 14.5 | 0.68 | 1.3 | 4.4 | 11 | 0.86 | 1.43 | 0.75 |
| 61 | Example | 400 | Zr | 14.3 | 0.76 | 1.2 | 3.8 | 14 | 0.87 | 1.45 | 0.73 |
| 62 | Example | 400 | Hf | 14.4 | 0.70 | 1.3 | 3.9 | 14 | 0.84 | 1.43 | 0.73 |
| 63 | Example | 400 | Mo | 14.7 | 0.73 | 1.3 | 4.1 | 13 | 0.85 | 1.44 | 0.69 |
| 64 | Example | 400 | V | 14.4 | 0.72 | 1.3 | 3.9 | 14 | 0.83 | 1.43 | 0.69 |
| 65 | Example | 400 | Nb:Hf = 1:1 | 14.7 | 0.68 | 1.3 | 3.8 | 15 | 0.85 | 1.44 | 0.73 |
| 66 | Example | 400 | Nb:Zr = 1:1 | 14.6 | 0.73 | 1.2 | 3.8 | 15 | 0.84 | 1.42 | 0.75 |

TABLE 5

| | | $Fe_{(1-(a+b+c+d))}M_aB_bP_cSi_d(\alpha = \beta = 0)$ | | | | | | | | | | | | |
|---|---|---|---|---|---|---|---|---|---|---|---|---|---|---|
| Sample No. | Example/Comparative Example | Fe $1-(\alpha+\beta)$ | M(Nb) a | B b | P c | Si d | R (nm) | Average circularity | Average aspect ratio | σ (nm) | $R^2/\sigma^2$ | Average elliptic circularity | Bs (T) | Hc (Oe) |
| 67 | Example | 0.810 | 0.070 | 0.090 | 0.030 | 0.000 | 14.4 | 0.71 | 1.3 | 4.8 | 9 | 0.83 | 1.48 | 0.85 |
| 68 | Example | 0.809 | 0.070 | 0.090 | 0.030 | 0.001 | 14.6 | 0.66 | 1.3 | 4.3 | 12 | 0.81 | 1.47 | 0.71 |
| 69 | Example | 0.808 | 0.070 | 0.090 | 0.030 | 0.002 | 14.8 | 0.68 | 1.3 | 4.4 | 11 | 0.83 | 1.45 | 0.73 |
| 70 | Example | 0.805 | 0.070 | 0.090 | 0.030 | 0.005 | 14.9 | 0.70 | 1.3 | 4.5 | 11 | 0.84 | 1.42 | 0.71 |
| 71 | Example | 0.800 | 0.070 | 0.090 | 0.030 | 0.010 | 16.4 | 0.75 | 1.3 | 4.7 | 12 | 0.86 | 1.40 | 0.74 |
| 72 | Example | 0.790 | 0.070 | 0.090 | 0.030 | 0.020 | 15.3 | 0.79 | 1.2 | 5.2 | 9 | 0.87 | 1.36 | 0.80 |
| 73 | Example | 0.770 | 0.070 | 0.090 | 0.030 | 0.040 | 13.7 | 0.66 | 1.2 | 4.2 | 11 | 0.87 | 1.33 | 0.75 |
| 74 | Example | 0.760 | 0.070 | 0.090 | 0.030 | 0.050 | 13.2 | 0.70 | 1.2 | 6.0 | 5 | 0.89 | 1.34 | 0.82 |

TABLE 6

| | | $Fe_{(1-(a+b+c+d))}M_aB_bP_cSi_d(\alpha = \beta = 0)$ | | | | | | | | | | | | |
|---|---|---|---|---|---|---|---|---|---|---|---|---|---|---|
| Sample No. | Example/Comparative Example | Fe $1-(\alpha+\beta)$ | M(Nb) a | B b | P c | Si d | R (nm) | Average circularity | Average aspect ratio | σ (nm) | $R^2/\sigma^2$ | Average elliptic circularity | Bs (T) | Hc (Oe) |
| 75 | Example | 0.830 | 0.070 | 0.090 | 0.010 | 0.000 | 14.7 | 0.73 | 1.3 | 4.4 | 11 | 0.83 | 1.51 | 0.86 |
| 76 | Example | 0.820 | 0.070 | 0.090 | 0.020 | 0.000 | 14.1 | 0.71 | 1.3 | 4.3 | 11 | 0.84 | 1.48 | 0.84 |
| 67 | Example | 0.810 | 0.070 | 0.090 | 0.030 | 0.000 | 14.4 | 0.71 | 1.3 | 4.8 | 9 | 0.83 | 1.48 | 0.85 |
| 77 | Example | 0.800 | 0.070 | 0.090 | 0.040 | 0.000 | 14.4 | 0.64 | 1.3 | 4.5 | 10 | 0.83 | 1.46 | 0.71 |
| 78 | Example | 0.790 | 0.070 | 0.090 | 0.050 | 0.000 | 14.8 | 0.68 | 1.3 | 4.5 | 11 | 0.84 | 1.42 | 0.82 |

TABLE 7

| | | $Fe_{(1-(a+b+c+d))}M_aB_bP_cSi_d(\alpha = \beta = 0)$ | | | | | | | | | | | | |
|---|---|---|---|---|---|---|---|---|---|---|---|---|---|---|
| Sample No. | Example/Comparative Example | Fe $1-(\alpha+\beta)$ | M(Nb) a | B b | P c | Si d | R (nm) | Average circularity | Average aspect ratio | σ (nm) | $R^2/\sigma^2$ | Average elliptic circularity | Bs (T) | Hc (Oe) |
| 79 | Example | 0.850 | 0.070 | 0.050 | 0.030 | 0.000 | 14.3 | 0.81 | 1.2 | 4.4 | 11 | 0.88 | 1.47 | 0.81 |
| 80 | Example | 0.830 | 0.070 | 0.070 | 0.030 | 0.000 | 14.3 | 0.73 | 1.3 | 4.3 | 11 | 0.83 | 1.49 | 0.83 |
| 67 | Example | 0.810 | 0.070 | 0.090 | 0.030 | 0.000 | 14.4 | 0.71 | 1.3 | 4.8 | 9 | 0.83 | 1.48 | 0.85 |
| 81 | Example | 0.800 | 0.070 | 0.100 | 0.030 | 0.000 | 15.3 | 0.71 | 1.3 | 4.6 | 11 | 0.84 | 1.44 | 0.79 |
| 82 | Example | 0.750 | 0.070 | 0.150 | 0.030 | 0.000 | 15.6 | 0.69 | 1.3 | 4.6 | 12 | 0.83 | 1.42 | 0.77 |
| 83 | Example | 0.700 | 0.070 | 0.200 | 0.030 | 0.000 | 15.9 | 0.66 | 1.3 | 5.1 | 10 | 0.84 | 1.39 | 0.67 |

TABLE 8

| Sample No. | Example/Comparative Example | $Fe_{(1-(a+b+c+d))}M_aB_bP_cSi_d(\alpha = \beta = 0)$ Fe 1 − (α + β) | M(Nb) a | B b | P c | Si d | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|---|---|---|
| 84 | Example | 0.840 | 0.000 | 0.090 | 0.030 | 0.040 | 15.3 | 0.78 | 1.1 | 4.4 | 12 | 0.88 | 1.45 | 0.88 |
| 85 | Example | 0.830 | 0.010 | 0.090 | 0.030 | 0.040 | 13.3 | 0.76 | 1.1 | 4.4 | 9 | 0.88 | 1.43 | 0.86 |
| 86 | Example | 0.810 | 0.030 | 0.090 | 0.030 | 0.040 | 13.6 | 0.75 | 1.2 | 4.3 | 10 | 0.87 | 1.39 | 0.83 |
| 87 | Example | 0.800 | 0.040 | 0.090 | 0.030 | 0.040 | 13.5 | 0.69 | 1.3 | 4.4 | 9 | 0.87 | 1.36 | 0.79 |
| 73 | Example | 0.770 | 0.070 | 0.090 | 0.030 | 0.040 | 13.7 | 0.66 | 1.2 | 4.2 | 11 | 0.87 | 1.33 | 0.75 |
| 88 | Example | 0.750 | 0.090 | 0.090 | 0.030 | 0.040 | 13.2 | 0.65 | 1.2 | 4.3 | 6 | 0.86 | 1.30 | 0.77 |

TABLE 9

| Sample No. | Example/ Comparative Example | $(Fe_{(1-(\alpha+\beta))}X1_\alpha X2_\beta)_{0.840}Nb_{0.070}B_{0.080}Si_{0.010}$ X1 type | X1 α × 0.840 | X2 type | X2 β × 0.840 | R (nm) | Average circularity | Average aspect ratio | σ (nm) | $R^2/\sigma^2$ | Average elliptic circularity | Bs (T) | Hc (Oe) |
|---|---|---|---|---|---|---|---|---|---|---|---|---|---|
| 48 | Example | — | 0.000 | — | 0.000 | 14.6 | 0.66 | 1.3 | 4.8 | 9 | 0.83 | 1.43 | 0.67 |
| 89 | Example | Co | 0.100 | — | 0.000 | 14.4 | 0.65 | 1.3 | 4.1 | 12 | 0.85 | 1.51 | 0.77 |
| 90 | Example | Co | 0.400 | — | 0.000 | 14.2 | 0.67 | 1.2 | 4.1 | 12 | 0.84 | 1.61 | 0.91 |
| 91 | Example | Ni | 0.100 | — | 0.000 | 14.3 | 0.66 | 1.2 | 4.2 | 12 | 0.85 | 1.41 | 0.63 |
| 92 | Example | Ni | 0.400 | — | 0.000 | 14.4 | 0.65 | 1.3 | 4.3 | 11 | 0.86 | 1.38 | 0.58 |
| 93 | Example | — | 0.000 | Al | 0.030 | 14.3 | 0.66 | 1.3 | 4.5 | 10 | 0.84 | 1.43 | 0.70 |
| 94 | Example | — | 0.000 | Zn | 0.030 | 14.3 | 0.67 | 1.2 | 4.3 | 11 | 0.84 | 1.42 | 0.71 |
| 95 | Example | — | 0.000 | Sn | 0.030 | 14.5 | 0.68 | 1.2 | 4.6 | 10 | 0.85 | 1.41 | 0.72 |
| 96 | Example | — | 0.000 | Cu | 0.030 | 10.5 | 0.67 | 1.1 | 3.4 | 10 | 0.89 | 1.42 | 0.84 |
| 97 | Example | — | 0.000 | Cr | 0.030 | 14.3 | 0.65 | 1.2 | 4.3 | 11 | 0.85 | 1.43 | 0.74 |
| 98 | Example | — | 0.000 | Ga | 0.030 | 14.2 | 0.66 | 1.2 | 4.3 | 11 | 0.86 | 1.42 | 0.74 |
| 99 | Example | — | 0.000 | Bi | 0.030 | 14.5 | 0.63 | 1.2 | 4.3 | 11 | 0.84 | 1.41 | 0.75 |
| 100 | Example | — | 0.000 | La | 0.030 | 14.3 | 0.66 | 1.2 | 4.5 | 10 | 0.85 | 1.43 | 0.76 |
| 101 | Example | — | 0.000 | Y | 0.030 | 14.4 | 0.62 | 1.2 | 4.5 | 10 | 0.83 | 1.42 | 0.73 |
| 102 | Example | — | 0.000 | N | 0.001 | 14.5 | 0.67 | 1.2 | 4.3 | 11 | 0.85 | 1.42 | 0.71 |
| 103 | Example | — | 0.000 | O | 0.001 | 14.6 | 0.67 | 1.2 | 4.3 | 12 | 0.84 | 1.41 | 0.72 |
| 104 | Example | — | 0.000 | C | 0.001 | 14.1 | 0.65 | 1.2 | 4.2 | 11 | 0.83 | 1.42 | 0.73 |
| 105 | Example | — | 0.000 | S | 0.001 | 13.9 | 0.68 | 1.2 | 4.1 | 11 | 0.82 | 1.42 | 0.71 |
| 106 | Example | Co | 0.100 | Al | 0.050 | 14.6 | 0.66 | 1.2 | 4.5 | 11 | 0.83 | 1.42 | 0.72 |
| 107 | Example | Co | 0.100 | Zn | 0.050 | 14.3 | 0.64 | 1.2 | 4.3 | 11 | 0.84 | 1.42 | 0.73 |
| 108 | Example | Co | 0.100 | Sn | 0.050 | 14.3 | 0.67 | 1.2 | 4.3 | 11 | 0.82 | 1.43 | 0.74 |
| 109 | Example | Co | 0.100 | Cu | 0.050 | 10.3 | 0.63 | 1.1 | 3.3 | 10 | 0.82 | 1.43 | 0.81 |
| 110 | Example | Co | 0.100 | Cr | 0.050 | 14.6 | 0.65 | 1.2 | 4.6 | 10 | 0.83 | 1.42 | 0.74 |
| 111 | Example | Co | 0.100 | La | 0.050 | 14.5 | 0.66 | 1.2 | 4.2 | 12 | 0.84 | 1.42 | 0.71 |
| 112 | Example | Co | 0.100 | Y | 0.050 | 14.7 | 0.62 | 1.2 | 4.5 | 11 | 0.83 | 1.42 | 0.73 |
| 113 | Example | Ni | 0.100 | Al | 0.050 | 14.3 | 0.65 | 1.2 | 4.4 | 11 | 0.82 | 1.42 | 0.77 |
| 114 | Example | Ni | 0.100 | Zn | 0.050 | 14.6 | 0.67 | 1.2 | 4.3 | 12 | 0.81 | 1.43 | 0.73 |
| 115 | Example | Ni | 0.100 | Sn | 0.050 | 14.6 | 0.68 | 1.2 | 4.1 | 13 | 0.84 | 1.41 | 0.74 |
| 116 | Example | Ni | 0.100 | Cu | 0.050 | 10.5 | 0.62 | 1.1 | 4.3 | 6 | 0.89 | 1.41 | 0.89 |
| 117 | Example | Ni | 0.100 | Cr | 0.050 | 14.3 | 0.64 | 1.2 | 4.3 | 11 | 0.85 | 1.41 | 0.75 |
| 118 | Example | Ni | 0.100 | La | 0.050 | 14.5 | 0.62 | 1.2 | 4.5 | 10 | 0.85 | 1.42 | 0.72 |
| 119 | Example | Ni | 0.100 | Y | 0.050 | 14.5 | 0.68 | 1.2 | 4.5 | 10 | 0.83 | 1.42 | 0.78 |

According to Tables 4 to 9, even if a composition of a soft magnetic alloy was changed, in Examples in which a stress was applied, a shape of nanocrystals showed the same tendency as a shape of nanocrystals in sample No. 48 in Table 3. An average Heywood diameter value R of the nanocrystals was 5.0 nm or more and 25.0 nm or less, and an average circularity of the nanocrystals was 0.50 or more and 0.90 or less. In each of Examples in Tables 4 to 9, Bs and He were good.

What is claimed is:

1. A soft magnetic alloy, comprising:

nanocrystals having an average Heywood diameter value of 5.0 nm or more and 25.0 nm or less, wherein an average circularity of the nanocrystals is 0.50 or more and 0.90 or less, and an average aspect ratio of the nanocrystals is 1.2 or more and 1.8 or less.

2. The soft magnetic alloy according to claim 1, wherein the average circularity of the nanocrystals is 0.50 or more and 0.80 or less.

3. The soft magnetic alloy according to claim 1, wherein the average circularity of the nanocrystals is 0.50 or more and 0.70 or less.

4. The soft magnetic alloy according to claim 1, wherein $R^2/\sigma^2$ is 30 or less, where R is the average Heywood diameter value of the nanocrystals, and σ is a standard deviation of Heywood diameters of the nanocrystals.

5. The soft magnetic alloy according to claim 1, comprising:

a main component having a composition formula $(Fe_{(1-(\alpha+\beta))}X1_\alpha X2_\beta)_{(1-(a+b+c+d))}M_aB_bP_cSi_d$ (a ratio of the number of atoms), wherein X1 is one or more selected from a group consisting of Co and Ni, X2 is one or more selected from a group consisting of Al, Mn, Ag, Zn, Sn, As, Sb, Cu, Cr, Ga, Bi, N, O, C, S, and a rare earth element, M is one or more selected from a group consisting of Nb, Hf, Zr, Ta, Mo, W, and V, and the following conditions are satisfied:

$0 \leq a \leq 0.150$ $0 \leq b \leq 0.200$ $0 \leq c \leq 0.200$ $0 \leq d \leq 0.200$ $0.100 \leq a+b+c+d \leq 0.300$ $\alpha \geq 0$, $\beta \geq 0$, and $0 \leq \alpha+\beta \leq 0.50$.

6. The soft magnetic alloy according to claim 1, wherein the soft magnetic alloy has a ribbon shape.

7. The soft magnetic alloy according to claim 1, wherein the soft magnetic alloy has a powder shape.

8. A magnetic core, comprising:

the soft magnetic alloy according to claim 1.

9. A magnetic component, comprising:

the magnetic core according to claim 8.

10. An electronic device, comprising:

the magnetic component according to claim 9.

11. The soft magnetic alloy according to claim 1, wherein an average elliptic circularity of the nanocrystals is 0.80 or more and 0.92 or less.

12. The soft magnetic alloy according to claim 1, wherein an average elliptic circularity of the nanocrystals is 0.83 or more and 0.92 or less.

13. The soft magnetic alloy according to claim 4, wherein $R^2/\sigma^2$ is 20 or less.

* * * * *